US006205586B1

(12) United States Patent
Jenkins, Sr. et al.

(10) Patent No.: US 6,205,586 B1
(45) Date of Patent: Mar. 27, 2001

(54) NECKTIE ASSEMBLY

(76) Inventors: Brett Jenkins, Sr., 2420 Palmyra St., Norfolk, VA (US) 23513; James E. Williams, Jr., 105 Scotch Tom Way, Yorktown, VA (US) 23692

( * ) Notice: Subject to any disclaimer, the term of this patent is extended or adjusted under 35 U.S.C. 154(b) by 0 days.

(21) Appl. No.: 09/586,461

(22) Filed: Jun. 3, 2000

(51) Int. Cl.[7] ..... A41D 25/12
(52) U.S. Cl. ..... 2/145; 2/156
(58) Field of Search ..... 2/145, 144, 148, 2/149, 150, 151, 154, 153, 156–157

(56) References Cited

U.S. PATENT DOCUMENTS 2,122,811 * 7/1938 Flumedoro ..... 2/150
2,565,149 * 8/1951 Shea ..... 2/145
3,737,917 * 6/1973 Orr ..... 2/150
5,165,112 11/1992 Dawes .
5,165,113 * 11/1992 Dawes ..... 2/150
5,774,893 7/1998 Torres .
5,778,453 7/1998 Chen .

* cited by examiner

*Primary Examiner*—John J. Calvert
*Assistant Examiner*—Tejash Patel
(74) *Attorney, Agent, or Firm*—Joy L. Bryant; Bart A. Singer

(57) ABSTRACT

The present invention is directed towards a necktie assembly having a separate simulated knot assembly and necktie blade. The simulated knot assembly includes a frustum that has a necktie passageway therethrough. The necktie blade has a front apron with a proximal section and a distal section. A neckband extends from the proximal section of the front apron. In use, the necktie blade passes through the necktie passageway in the frustum, and attaches to a portion of the simulated knot assembly. Because the simulated knot assembly and necktie blade are separate pieces, stylish combinations of simulated knot assemblies and necktie blades can be worn.

21 Claims, 5 Drawing Sheets

NECKTIE ASSEMBLY

FIELD OF THE INVENTION

The present invention relates to a necktie assembly. In particular, it relates to a necktie assembly with a detachable and interchangeable front apron and simulated knot assembly.

BACKGROUND OF THE INVENTION

Various types of neckwear have been worn in fashionable society for several centuries. French officers returning from the Thirty Years' War brought stylish Croatian neckerchiefs with them. The apparel was introduced in England by Charles II and shortly thereafter found its way to the American colonies. By the nineteenth century, the neckerchiefs had evolved into numerous styles of cravats and an equally numerous set of knots for tying them. The rise of the middle-class office worker led to the introduction of the modern necktie. Unlike the wealthy, working-class people were unable to spend enormous amounts of time carefully knotting their neckwear. Their neckwear needed to be comfortable and easy to don. The dominant knot was relatively simple to tie, easy to loosen, and yet did not easily come undone. The knot became known as the "four-in-hand" knot because the long trailing ends emerging from the front of the knot resembled the reins of four-horse carriages. The Windsor knot, sometimes also called the double Windsor, was named for the Duke of Windsor, who appreciated a somewhat thicker knot than the standard four-in-hand. Perhaps attracted by its added complexity, the Windsor knot is preferred by political and business leaders, as well as foreign royalty.

Just as mid-nineteenth-century office life heralded in the era of the modern tie, twenty-first century office life brings with it a different view of neckwear. Many workers no longer need to regularly wear a necktie, so although the four-in-hand knot is not particularly difficult to master when practiced regularly, it can be difficult to remember for those few occasions when a necktie is required. In addition, because many individuals no longer wear a necktie daily, they also typically do not possess the great assortment of neckties that were once a common part of the wardrobe owned by many older office workers. As such, those occasions that require a necktie may find many individuals without neckwear that suitably matches the individual's clothing, and without the skill to adequately tie any neckwear that might be owned. The current invention simultaneously addresses both of these problems.

Another problem with traditional neckties is their limited range of adjustment. An individual with a long torso and a thick neck may find that the front apron terminates well above the individual's waist. Alternatively, an individual with a short torso and a small neck may find that the front apron continues well below the individual's waist. Both situations present an awkward appearance. Preferred embodiments of the present invention alleviate this problem.

Pre-tied neckwear and neckwear with simulated knots have existed for a long time. Inventors have expended great effort to develop neckwear that does not need to be tied.

In U.S. Pat. No. 5,165,112, Dawes discloses an assemblable necktie that includes a collar assembly, a knot assembly, a replacement tie assembly, and a tie assembly securement. The knot assembly comprises a first end portion having a collar loop formed therein for retaining the collar assembly, an intermediate portion, and a second end portion. The first end portion, intermediate portion, and the second end portion are so foldable so as to form a knot during use, having the appearance of a knot in a conventional tie. The replaceable tie assembly is securable to the knot assembly. The Dawes assemblable necktie requires the use of tie assembly securement and the procedure for folding the knot assembly is complicated. The device disclosed in U.S. Pat. No. 5,778,453 to Chen includes a knot formed with a seat, a binding device having a fixing block removably engaged with the seat of the knot, and a front apron provided with a fastening means at an upper end thereof engageable with the knot, whereby the front apron of the necktie can be changed as desired and the necktie can be easily converted to a bow tie. The device is mechanically complex and somewhat bulky. In addition, the clip-on front apron is likely to tension the front apron unnaturally and produce an awkward-looking necktie. The clip-on front apron also is not adjustable in length.

Torres proposed a three-piece necktie assembly in U.S. Pat. No. 5,774,893. The assembly incorporates a simulated necktie knot and a neckband that allows a fabric necktie tail portion to be added without making a conventional knot. The neckband may be elastic and may be opened, closed and adjusted in a number of ways. Because the fabric necktie portion is simply folded over the neckband portion, the fabric necktie portion is not firmly attached and may slip; resulting in a front apron that becomes unduly long or short. In addition, the fabric necktie portion must be readjusted for length prior to each wearing.

SUMMARY OF THE INVENTION

The present invention overcomes many of the difficulties with prior necktie assemblies. The necktie assembly of the present invention includes only two principal parts, a necktie blade and a simulated knot assembly. The simulated knot assembly comprises a frustum with a necktie passageway therethrough. The necktie blade passes through the necktie passageway of the frustum and permits the front apron of the necktie assembly to hang similarly to a conventional necktie. Because the necktie blade of the present invention is secured to the simulated knot assembly, inadvertent slippage of the front apron is inhibited. Although the length of the front apron of the necktie blade is adjustable, after its initial sizing, the necktie blade length does not need to be readjusted. A variety of simulated knot assemblies of the present invention may be interchanged with a single necktie blade. Alternatively, a single simulated knot assembly may be used with any of a variety of necktie blades. This provides the user with a wide variety of fashionable combinations while using a limited number of simulated knot assemblies and necktie blades.

Additional advantages of the invention will be set forth in part in the description that follows, and in part will be obvious from the description, or may be learned by practice of the invention. The objects and advantages of the invention will be obtained by means of instrumentalities in combinations particularly pointed out in the appended claims.

BRIEF DESCRIPTION OF THE DRAWINGS

The accompanying drawings illustrate a complete embodiment of the invention according to the best modes so far devised for the practical application of the principles thereof, and in which.

DETAILED DESCRIPTION OF PREFERRED EMBODIMENTS

Figure 1:
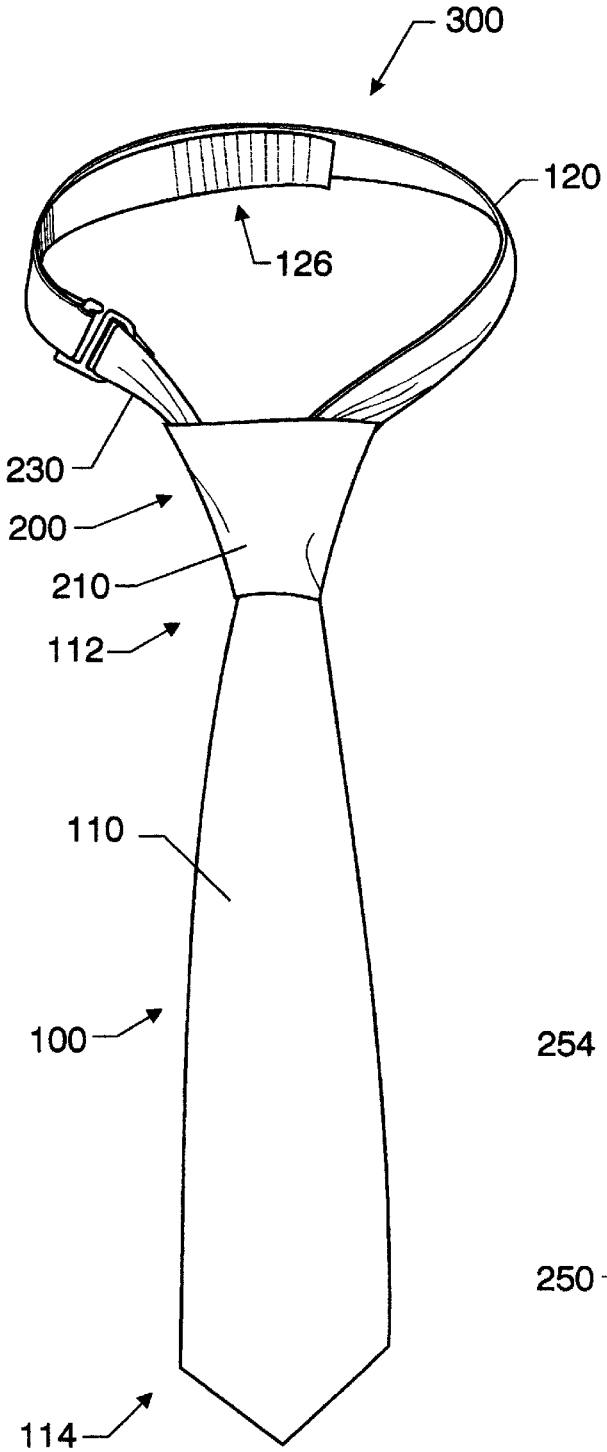
FIG. 1 shows an embodiment the necktie assembly of the present invention.

Referring now to the drawings, where similar elements are numbered the same, FIG. 1 depicts an embodiment of the necktie assembly 300 of the present invention. The necktie assembly 300 is comprised of a simulated knot assembly 200 and a necktie blade 100. Each necktie blade 100 comprises a front apron 110 having a proximal section 112 and a distal section 114. A neckband 120 extends from the proximal section 112 of the front apron 110 and terminates in a tail portion 126. The necktie blade 110 passes through the simulated knot assembly 200 and is attached to a portion of the simulated knot assembly 200. Any method of attachment known to those of ordinary skill in the art may be used. For example, the necktie blade 100 may be attached to the frustum 210 of the simulated knot assembly 200, or to a knot strap 230, which is affixed to the frustum 210.

Figure 2A:
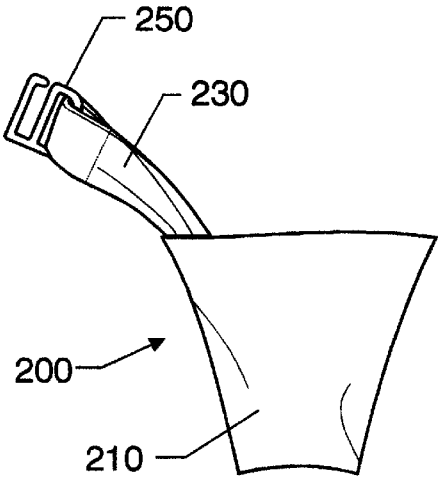
FIG. 2A shows a front view of a preferred embodiment of a simulated knot assembly.
Figure 2B:
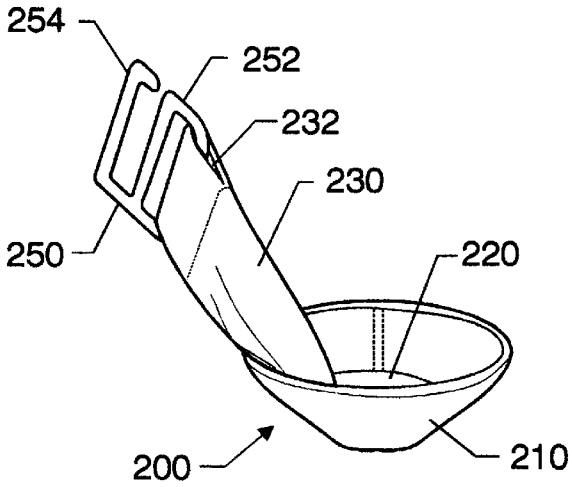
FIG. 2B shows a view of the simulated knot assembly from about 45 degrees above the horizontal.

FIGS. 2A and 2B illustrate a front view and a view from about 45 degrees above the horizontal, respectively, of a preferred embodiment of the simulated knot assembly 200. The simulated knot assembly 200 includes a frustum 210 having a necktie passageway 220 therethrough and a knot strap 230 affixed to the frustum 210. In this embodiment, a strap hook 250 is affixed to the knot strap 230. The strap hook 250 is shaped like a flattened, lower-case "e" with a closed portion 252 and an open hook portion 254. However, any other strap hook known to those of ordinary skill in the art may be used.

The knot strap 230 is a strip of material affixed to the frustum 210. The knot strap 230 may be fixed to the frustum 210 in any appropriate manner. Its length can vary widely from a small stub to an elongated strip many centimeters in length. Preferably, the knot strap 230 extends beyond the top of the frustum 210 a distance ranging from about 5cm to about 15 cm. In use, this size knot strap 230 permits the knot strap 230 to fasten to the necktie blade 100 (see FIG. 1) approximately one quarter of the distance around the wearers neck, roughly below the ear. Preferably the knot strap 230 is made from fabric, but other materials, such as various types of plastics or leather may be used. The knot strap 230 may also be made from a composite including either multiple types of fabrics or fabrics combined with other materials. The strap hook 250, illustrated in FIGS. 2A and 2B is a preferred structure that facilitates fastening the knot strap 230 to the necktie blade 100. Preferably, the strap hook 250 is secured to the knot strap 230 by threading a first portion of the knot strap 230 through the closed portion 252 of the strap hook 250. Folding and securing the first portion of the knot strap 230 to a second portion of the knot strap 230 forms a knot strap loop 232. Any appropriate means can be used to secure the knot strap loop 232. Stitching is preferred although adhesives, hook and loop fastener material, snaps, or other means known to those skilled in the art can be substituted.

The frustum 210 has a wide top and a narrow bottom with a necktie passageway 220 extending from the top to the bottom. To best simulate the appearance of a tied necktie knot, the width ratio of the top to the bottom ranges from about 1.5 cm to about 3 cm. However, unless otherwise specified, the frustum 210 is free to have any top to bottom width ratio that maintains the top wider than the bottom. The frustum 210 is not required to have a fixed cross section. In fact, in the preferred embodiment of the frustum 210, illustrated in FIGS. 2A and 2B, the frustum 210 is flexible and the details of its shape can vary greatly.

In one embodiment, the frustum 210 is made from a flexible piece of material wrapped into a loop. The center of the loop serves as the necktie passageway 220. The flexible piece of material is preferably a fabric, but other materials, including, but not limited to various types of plastics or leather may be used. The flexible piece of material may also be made from a composite including either multiple types of fabrics or fabrics combined with other materials.

Figure 3:
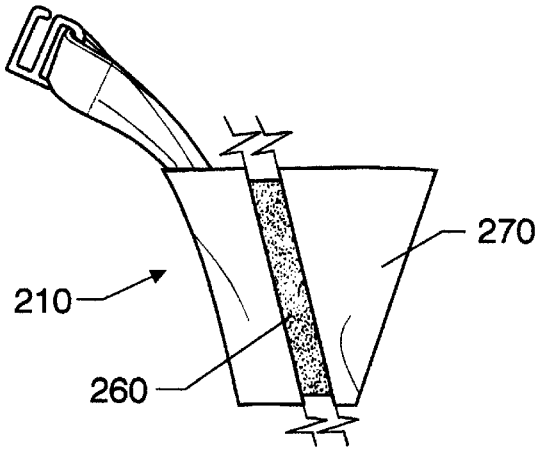
FIG. 3 illustrates an alternative embodiment of a simulated knot assembly that includes a shape-maintaining support overlain by a fabric cover.

An alternate embodiment of the frustum 210 is depicted in FIG. 3. In this embodiment, a shape-maintaining support 260 is overlain by a fabric cover 270. The shape-maintaining support 260 provides an essentially consistent shape to the frustum 210. The shape-maintaining support 260 can be either rigid or flexible. However, it should be stiffer than the fabric cover 270 to provide some support. Preferably the shape-maintaining support 260 is made from a flexible plastic although other materials known to be appropriate to those of ordinary skill in the art can also be used. In yet another embodiment (not illustrated) of the frustum, the frustum is made from a rigid material, such as wood, metal, or a rigid plastic without any fabric cover.

Figure 4A:
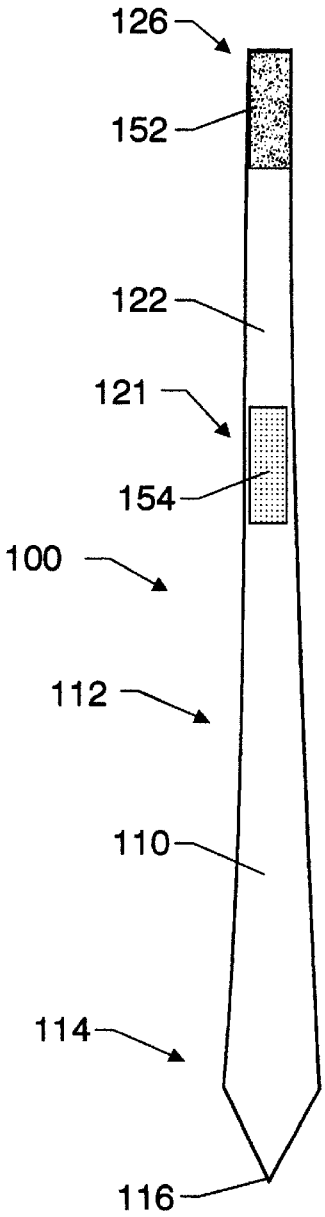
FIG. 4A shows the inner surface of a preferred embodiment of a necktie blade.
Figure 4B:
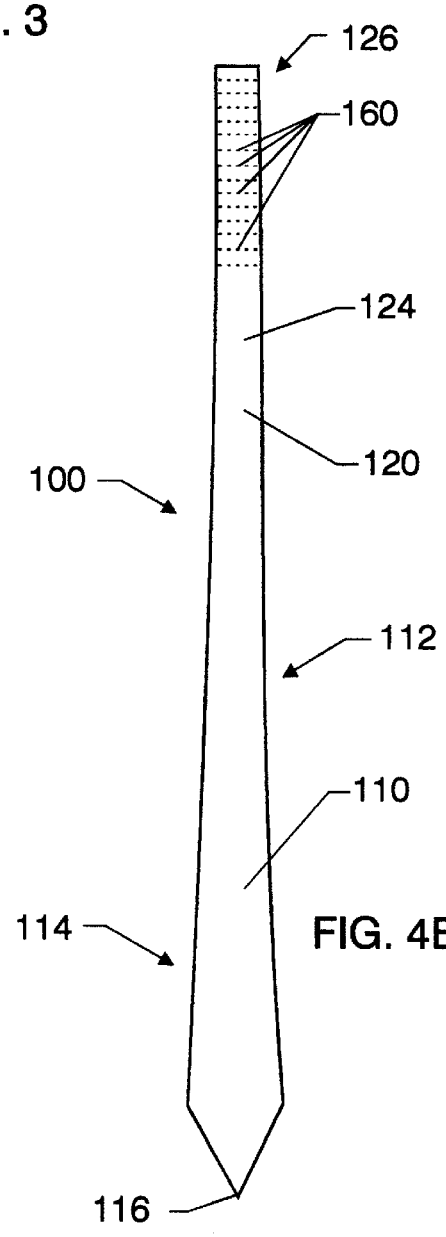
FIG. 4B shows the outer surface of the necktie blade.

FIGS. 4A and 4B show inner 122 and outer surfaces 124, respectively, of a preferred embodiment of a necktie blade 100. The necktie blade 100 includes a front apron 110 and a neckband 120. As used in this application, a necktie blade 100 is a strip of flexible material that has a length much greater than its width and its width is greater than its thickness. The necktie blade 100 does not include rope or string ties in which the thickness and the width are approximately the same. The division between the front apron 110 and the neckband 120 is not precisely defined. The front apron 110 has a distal section 114, which is that portion of the necktie blade 100 that is furthest from the wearer's neck when it is properly worn, and a proximal section 112 that is in relative proximity to the wearer's neck. The neckband 120 extends from the proximal section 112 of the front apron 110 and terminates in a tail portion 126. Although not necessary to the invention, preferably the width of the neckband 120 is nearly constant and is typically about 3 cm. This size enables the neckband 120 to fit under the collar of most shirts.

In contrast to the neckband 120, although not necessary to the invention, the front apron 110 typically has increasing width from its proximal section 112 to its distal section 114 until it abruptly narrows to end in a point 116. Preferably, the abruptly narrowing region occupies a distance from the point 116 that is approximately equal to half of the maximum width of the front apron 110. In such a case the angle created at the point 116 is approximately 90 degrees. The details of the widening and narrowing of the front apron 110 are driven by aesthetic considerations and therefore may vary considerably as fashion trends change. For example, a tie blade 100 may have a front apron 110 of constant width without a point 116.

Preferably both the neckband 120 and the front apron 110 are made from similar materials or combinations of materials. Preferably the entire necktie blade 100 is constructed from a combination two fabric layers, one that is exposed and a second, called the interfacing, that is generally not viewable. Most preferably the material used for the exposed fabric will be twill, faille, poplin, organdie, shantung, or for expensive tie blades 100, silk. The preferred material for the interfacing is generally a coarser fabric to help hold the shape of the necktie blade 100. Although the two-layer fabric construction is preferred, the necktie blade 100 may be constructed in any alternative appropriate fashion, for example, from a single fabric layer or from some other materials, such as various types of plastics, leather, or composites.

Figure 5:
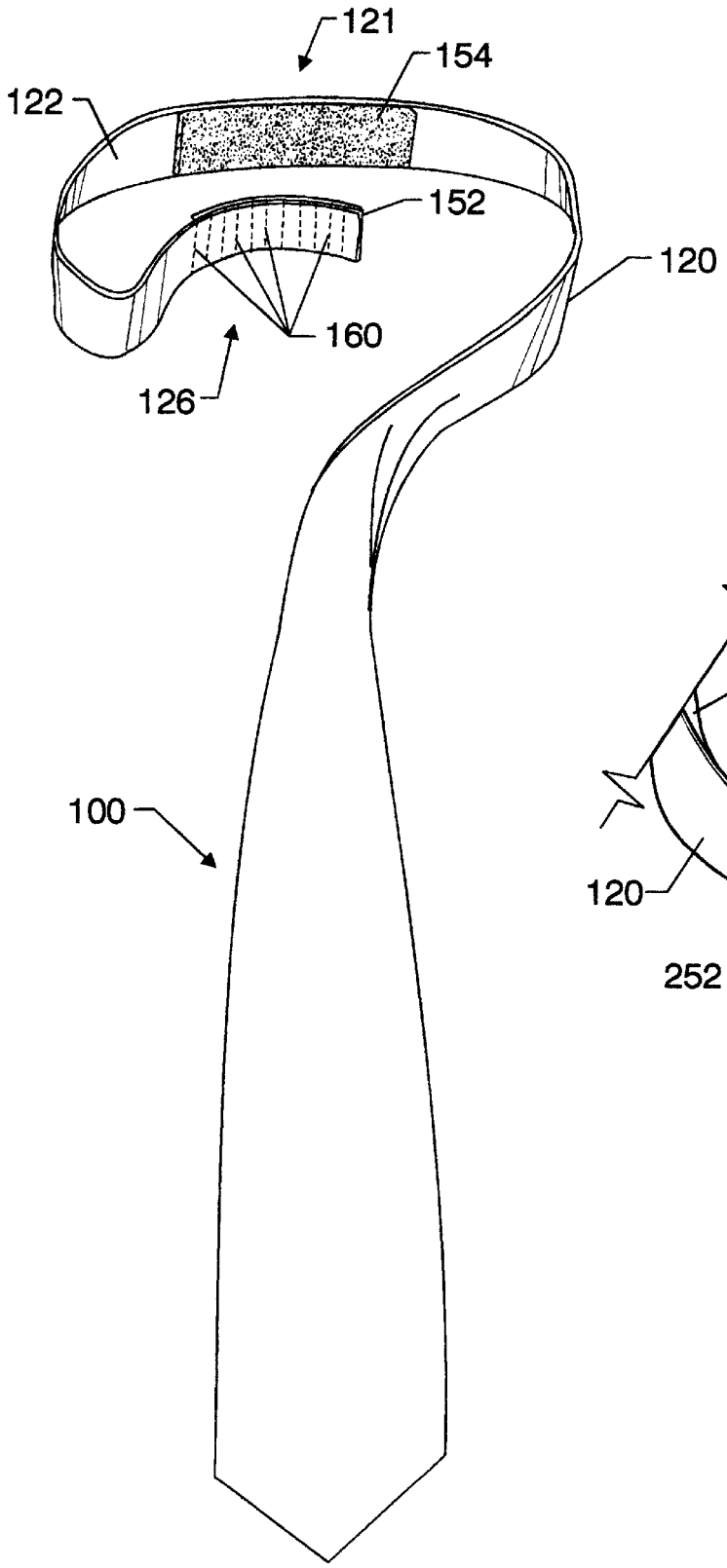
FIG. 5 illustrates a preferred embodiment of the necktie blade with the neckband being folded prior to forming a neckband loop.

The preferred embodiment illustrated in FIGS. 4A and 4B includes hook 152 and loop 154 fastener material (sold under the trade name VELCRO) attached to the inner surface 122 of the neckband 120. As shown in FIG. 5, the hook 152 and loop 154 fastener material serves as a neckband fastener for adjustably fastening a medial portion 121 of the neckband inner surface 122 to the tail portion 126 of the neckband inner surface 122 to form a neckband loop (not shown). Most preferably, the loop fastener material 154 is attached to the medial portion 121 of the neckband inner surface 122 and the hook fastener material 152 is attached to the tail portion 126 of the neckband inner surface 122. With this arrangement, when properly used, the fuzzy loop fastener material 154 is directed towards the wearers neck, while the prickly hook fastener material 152 is directed away from the wearer's neck. However embodiments with the hook fastener material 152 attached to the medial portion 121 of the neckband inner surface 122 and the loop fastener material 154 attached to the tail portion 126 of the neckband inner surface 122 are also reasonable and may be favored by other design considerations.

Although the preferred embodiments use hook and loop fastener material as the neckband fastener, other fasteners may be used to adjustably fasten the medial portion 121 of the neckband inner surface 122 to the tail portion 126 of the neckband inner surface 122 to form a neckband loop (not shown). For example, at least one of a series of snaps (not shown) mounted on the medial portion 121 of the neckband inner surface 122 could mate with one or more snaps (not shown) mounted on the tail portion 126 of the neckband inner surface 122. Similarly, at least one of a series of snaps (not shown) mounted on the tail portion 126 of the neckband inner surface 122 could mate with one or more snaps (not shown) mounted on the medial portion 121 of the neckband inner surface 122. Any other appropriate fastener known to those skilled in the art could be used as a neckband fastener.

Figure 6:
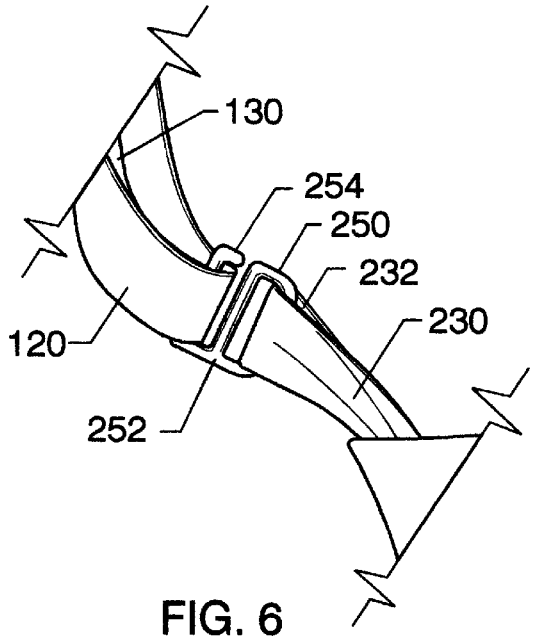
FIG. 6 illustrates a magnified view of the preferred way to attach the neckband to the knot strap.

FIG. 6 illustrates a magnified view of the preferred attachment of the knot strap 230 to the neckband 120. In this preferred embodiment, the open hook portion 254 of the strap hook 250 hooks to the neckband loop 130 to fasten the neckband 120 to the knot strap 230. Alternatively, (not shown) the tail portion of the neckband is threaded through the closed portion of the strap hook before the medial portion of the neckband is attached to the tail portion. Then the open hook portion of the strap hook hooks to the knot strap loop. In yet another embodiment (not shown), a snap is attached to the knot strap and the mating portion of the snap is fixed to the neckband. Similarly, hook and eye fasteners could be used with either the hook or the eye portion(s) fixed to the knot strap and the mating portion(s) fixed to the neckband. Any other appropriate fasteners could be used to fasten the knot strap to the neckband.

Another embodiment of the invention eliminates the need for the knot strap 230. In this embodiment (not shown), the neckband of the necktie blade is attached directly to the frustum of the simulated knot assembly. The attachment is accomplished by any appropriate means known to those skilled in the art. For example, a snap, book and loop fastener material, a book and eye fastener, or a strap hook like that used on the knot strap, but attached directly to the frustum are all possible ways to attach the necktie blade directly to the frustum. The attachment is located either near the tail portion of the neckband or near the proximal portion of the front apron, at the beginning of the neckband.

With reference back to FIGS. 4B and 5, the hook fastener material 152 is attached to the tail portion 126 of the neckband inner surface 122 with a series of spaced stitch lines 160. Each stitch line 160 extends substantially across the width of the neckband 120. The thread used to sew each stitch line 160 is preferably independently secured and the stitches in each stitch line 160 preferably extend through the thickness of the neckband 120. The use of spaced stitch lines 160 permits excess length of the neckband 120 to be cut off with minimal fraying of the cut end. Preferably such a cut would be essentially parallel to one of the stitch lines 160. The stitch line 160 that is closest to the end would limit any fraying of the end. As discussed earlier, the most preferred embodiment employs hook fastener material 152 on the tail portion 126 of the neckband inner surface 122. However, the prickly hook material is more difficult to cut than the fuzzy loop material. Therefore, in some instances, it may be preferable to attach the loop fastener material 154 to the tail portion 126 of the neckband inner surface 122 and hook fastener material 152 to the medial portion 121.

This configuration permits the length of the necktie blade 100 to be adjusted according to the length of the wearer's torso. For example, a shorter person would require a shorter necktie blade 100 and would thus remove more of the tail portion 126. Alternatively, a taller person would require a longer necktie blade 100 and may not remove any of the tail portion 126. Similar adjustments are made to account for the circumference of the wearer's neck. For a wearer with a small neck, more of the tail portion 126 would be removed than for that for someone with a large neck.

Figure 7A:
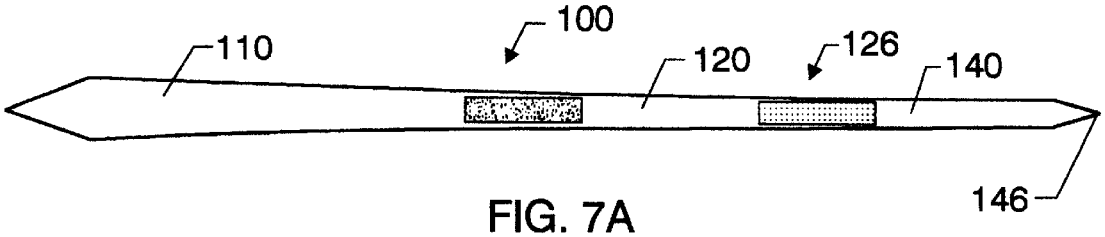
FIG. 7A shows the inner surface of an alternative embodiment of a necktie blade that includes a rear apron.
Figure 7B:
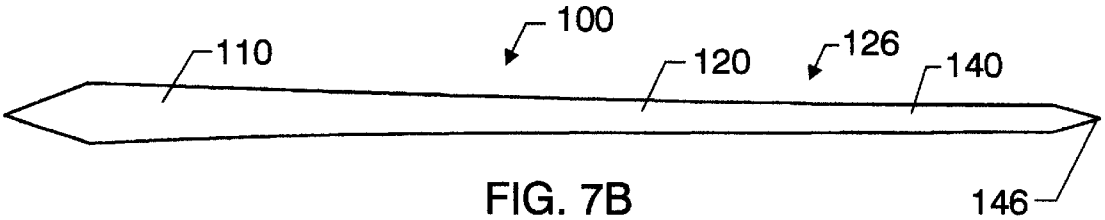
FIG. 7B shows the outer surface of the alternative embodiment.

Another embodiment of the necktie blade 100 is illustrated in FIGS. 7A and 7B. In this embodiment, a rear apron 140 extends from the tail portion 126 of the neckband 120. In use, the rear apron 140 passes through the necktie passageway 220 (shown in FIGS. 2A and 2B) to lie behind the front apron 110. Although the invention does not require the rear apron 140 to have any special shape, preferably, the rear apron 140 would widen slightly before terminating in a rear point 146. However, the width of the rear apron 140 will generally be less than that of the front apron 110. Preferably the rear apron 140 is made from the same material as the neckband 120 and the front apron 110.

A wearer is attired with a necktie of the present invention with a single simulated knot assembly and one necktie blade. However, when a variety is desirable, more than one simulated knot assembly and necktie blade is provided.

A wearer chooses a single simulated knot assembly and a necktie blade. The simulated knot assembly and the necktie blade are chosen according to the particular aesthetic preferences of the user. In a conventional tie, the colors and pattern in the knot and the front apron are similar because the knot is just a tied-up piece of the same tie blade as the front apron. However, in the present invention, the simulated knot assembly and the necktie blade are separate pieces. Hence the pattern and colors of the chosen simulated knot assembly can differ from the pattern and colors of the chosen necktie blade. For instance, a red and green plaid necktie blade can be chosen to go with a solid red simulated knot assembly.

Figure 8A:
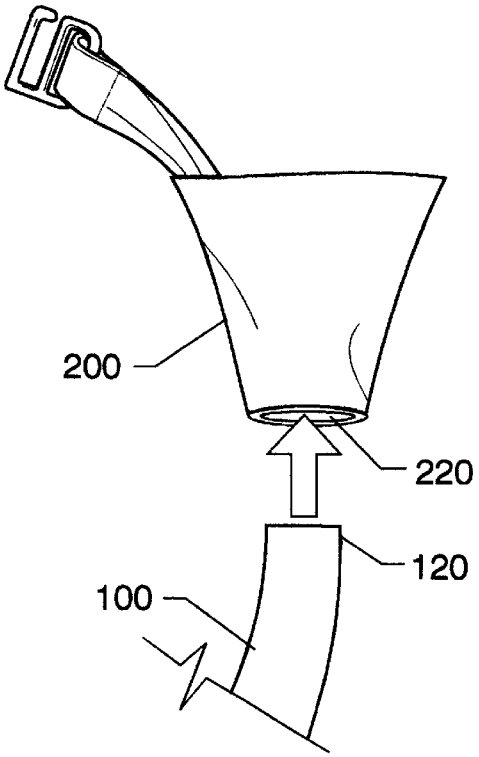
FIG. 8A shows the insertion of the necktie blade through the simulated knot assembly.
Figure 8B:
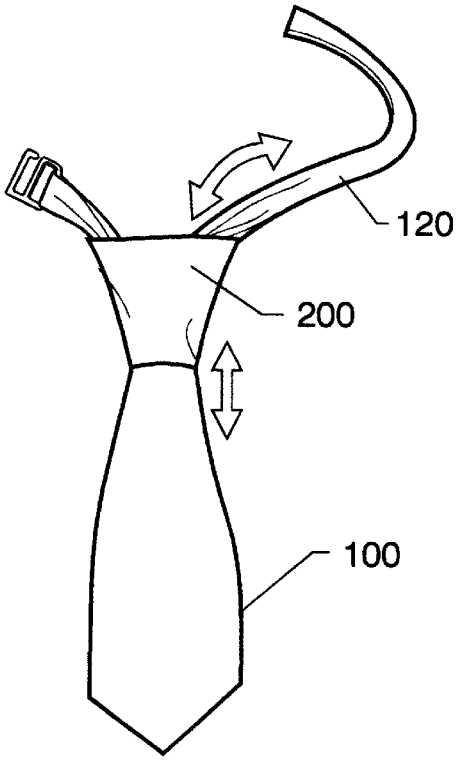
FIG. 8B illustrates adjusting the length of the necktie blade that is exposed below the simulated knot assembly.

FIG. 8A shows the preferred way of inserting the chosen necktie blade 100 through the necktie passageway 220 of the simulated knot assembly 200. Here the neckband 120 is threaded through the necktie passageway 220 from the bottom to the top. Alternatively, the front apron (not shown) can be threaded through the necktie passageway 220 from the top to the bottom. The length of the necktie blade 100 that is exposed below the simulated knot assembly 200 is adjusted as shown in FIG. 8B. The adjustment involves pulling the necktie blade 100 from above or below the simulated knot assembly 200 to shorten or lengthen, respectively, the length of the necktie blade 100 that is exposed below the simulated knot assembly 200. As mentioned previously, the length will be dependent on the wearer's torso length.

Figure 8C:
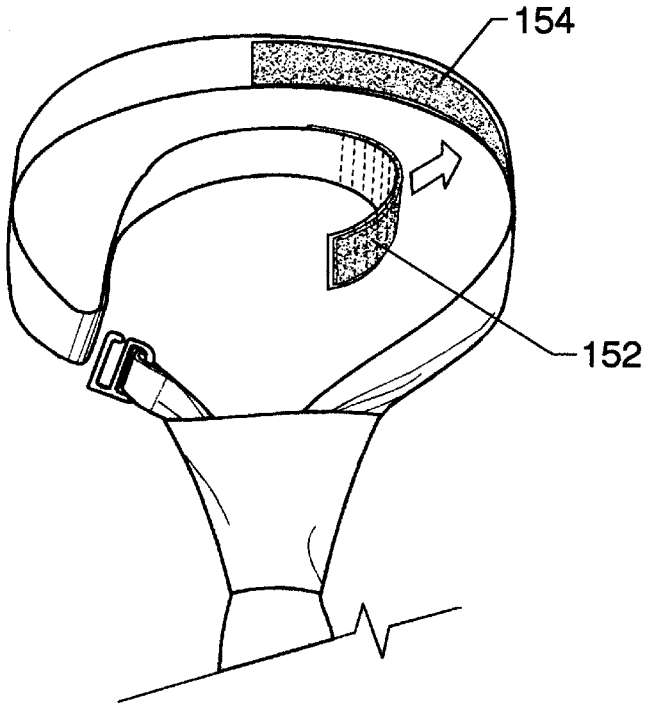
FIG. 8C shows the mating of the hook and loop fastener material.
Figure 8D:
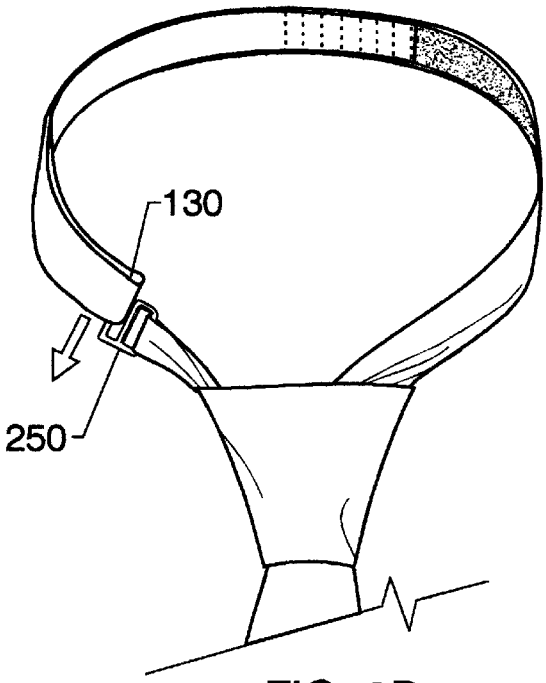
FIG. 8D shows the strap hook hooking the neckband loop.

The neckband is wrapped around the back of the wearer's neck and, as shown in FIG. 8C, the hook fastener material 152 is mated with the loop fastener material 154. This produces the neckband loop 130, which is shown in FIG. 8D. In FIG. 8D, the strap hook 250 is shown hooking to the neckband loop 130.

Preferably, any excess length of the neckband is cut by cutting the neckband essentially parallel to one of the spaced stitch lines. By cutting essentially parallel to one of the spaced stitch lines, fraying of the end of the tie blade is inhibited.

The above steps do not need to be performed in the order explained. In particular, the hook and loop material can be mated to form a neckband loop 130 prior to the neckband 120 being wrapped around the back of the wearer's neck. In fact, after the initial fitting and the length is properly adjusted, the wearer may remove and subsequently replace the necktie blade 100 simply by unhooking and subsequently rehooking the strap hook 250 to the neckband loop 130. Separating and re-mating of the hook and loop fastener material is not required unless the tie length needs to be adjusted.

Appropriate modifications to the above process are made for the various alternative embodiments. In particular, if a necktie blade with a rear apron is used, the rear apron must be passed through the necktie passageway a second time so that the rear apron can lie behind the front apron.

The necktie assemblies discussed above can be sold as a variety of neckware kits. In one kit, a single simulated knot assembly and a plurality of necktie blades are matched together. Diverse styles of necktie blades can be included as part of the same kit. Alternatively, a neckware kit may comprise a plurality of simulated knot assemblies and a single necktie blade. Many different styles of simulated knot assemblies can be included as part of the same kit. Clearly other combinations of simulated knot assemblies and necktie blades can be sold as similar neckware kits.

The above description and drawings are only illustrative of preferred embodiments which achieve the objects, features and advantages of the present invention, and it is not intended that the present invention be limited thereto. Any modification of the present invention that comes within the spirit and scope of the following claims is considered part of the present invention.

What is claimed is:

1. A method for attiring a wearer with a necktie, the method comprising the steps of:

a) providing at least one simulated knot assembly and at least one necktie blade, each simulated knot assembly comprising:
  a frustum having a necktie passageway therethrough,
  a knot strap affixed to the frustum, and
  a strap book affixed to the knot strap; and each necktie blade comprising:
    a front apron having a proximal section and a distal section, and
    a neckband extending from the proximal section of the front apron, the neckband having an inner surface and an outer surface, and having loop fastener material attached to a medial portion of the neckband inner surface and hook fastener material attached to a tail portion of the neckband inner surface;

b) choosing a simulated knot assembly and a necktie blade;

c) inserting the chosen necktie blade through the necktie passageway of the chosen simulated knot assembly;

d) adjusting the length of the necktie blade exposed below the simulated knot assembly;

e) wrapping the neckband around the back of the wearers neck;

f) mating the hook fastener material to the loop fastener material to form a neckband loop; and g) hooking the strap hook to the neckband loop.

2. A method for attiring a wearer with a necktie, according to claim 1, further comprising the step of: cutting excess length of the neckband.

3. A method for attiring a wearer with a necktie, according to claim 2, wherein the hook fastener material attached to the tail portion of the neckband inner surface is attached with a series of spaced stitch lines, each stitch line extending substantially across the width of the neckband and wherein a cut is made essentially parallel to one of the stitch lines.

4. A method for attiring a wearer with a necktie, the method comprising the steps of:

a) providing at least one simulated knot assembly and at least one necktie blade; each simulated knot assembly comprising:
  a frustum having a necktie passageway therethrough,
  a knot strap affixed to the frustum, and a
  a strap hook affixed to the knot strap; and each necktie blade comprising:
    a front apron having a proximal section and a distal section, and
    a neckband extending from the proximal section of the front apron, the neckband having an inner surface and an outer surface, and having hook fastener material attached to a medial portion of the neckband inner surface and loop fastener material attached to a tail portion of the neckband inner surface;

b) choosing a simulated knot assembly and a necktie blade;

c) inserting the chosen necktie blade through the necktie passageway of the chosen simulated knot assembly;

d) adjusting the length of the necktie blade exposed below the simulated knot assembly;

e) wrapping the neckband around the back of the wearer's neck;

f) mating the hook fastener material to the loop fastener material; and g) hooking the strap hook to the neckband loop.

5. A method for attiring a wearer with a necktie, according to claim 4, further comprising the step of cutting excess length of the neckband.

6. A method for attiring a wearer with a necktie, according to claim 5, wherein the loop fastener material attached to the tail portion of the neckband inner surface is attached with a series of spaced stitch lines, each stitch line extending substantially across the width of the neckband and wherein a cut is made essentially parallel to one of the stitch lines.

7. A neckwear kit, comprising:

a simulated knot assembly, comprising:

a frustum having a necktie passageway therethrough, and a knot strap affixed to the frustum; and a plurality of necktie blades, each necktie blade comprising:

a front apron having a proximal section and a distal section, and a neckband extending from the proximal section of the front apron.

8. A neckwear kit, according to claim 7, wherein the simulated knot assembly further comprises a strap hook affixed to the knot strap; and wherein the neckband of each necktie blade has an inner surface and an outer surface, and a neckband fastener for adjustably fastening a medial portion of the neckband inner surface to a tail portion of the neckband inner surface, thereby forming a neckband loop for receiving the strap hook.

9. A neckwear kit, according to claim 7, wherein the frustum of the simulated knot assembly comprises a shape-maintaining support overlain by a fabric cover.

10. A neckwear kit comprising:

a plurality of simulated knot assemblies, each simulated knot assembly comprising:

a frustum having a necktie passageway therethrough, and a knot strap affixed to the frustum;

and a necktie blade, comprising:

a front apron having a proximal section and a distal section, and a neckband extending from the proximal section of the front apron.

11. A neckwear kit, according to claim 10, wherein:

each simulated knot assembly further comprises a strap hook affixed to the knot strap; and the neckband of the necktie blade has an inner surface and an outer surface, and a neckband fastener for adjustably fastening a medial portion of the neckband inner surface to a tail portion of the neckband inner surface, thereby forming a neckband loop for receiving the strap hook.

12. A neckwear kit, according to claim 10, wherein the frustum of each simulated knot assembly comprises a shape-maintaining support overlain by a fabric cover.

13. A necktie assembly, comprising:

a simulated knot assembly, wherein the simulated knot assembly comprises a frustum having a necktie passageway theretbrough and a knot strap affixed to the frustum;

a necktie blade, wherein the necktie blade comprises a front apron having a proximal section and a distal section, and a necckband extending from the proximal section of the front apron and teniinating in a tail portion; and wherein the necktie blade passes Through the necktie passageway in the frustum and the neckband attaches to the knot strap.

14. A necktie assembly, according to claim 13, wherein:

the neckband has an inner surface and an outer surface and a neckband fastener for adjustably fastening a medial portion of the neckband inner surface to the tail portion of the neckband inner surface, thereby forming a neckband loop;

a strap hook is affixed to the knot strap; and wherein the strap hook hooks to the neckband loop to fasten the neckband to the knot strap.

15. A necktie assembly, according to claim 14, wherein the neckband fastener comprises:

loop fastener material attached to the medial portion of the neckband inner surface; and hook faster material attached to the tail portion of the neckband inner surface.

16. A necktie assembly, according to claim 15, wherein the necktie blade further comprises a rear apron extending from the tail portion of the neckband, whereby the rear apron lies behind the front apron after the necktie blade passes a second time through the necktie passageway in the frustum.

17. A necktie assembly, according to claim 15, wherein the hook fastener material attached to the tail portion of the neckband inner surface is attached with a series of spaced stitch lines, each stitch line extending substantially across the width of the neckband.

18. A necktie assembly, according to claim 14, wherein the neckband fastener comprises:

hook fastener material attached to the medial portion of the neckband inner surface; and loop fastener material attached to the tail portion of the neckband surface.

19. A necktie assembly, according to claim 18, wherein the necktie blade further comprises a tear apron extending from the tail portion of the neckband, whereby the rear apron lies behind the front apron after the necktie blade passes a second time through the necktie passageway in the frustum.

20. A necktie assembly, according to claim 18, wherein the loop fastener material attached to the tail portion of the neckband inner surface is attached with a series of spaced stitch lines, each stitch line extending sbstantially across the width of the neckband.

21. A necktie assembly, according to claim 13, wherein the frustrum of the simulated knot assembly comprises a shape-maintaining support overlain by a fabric cover.

* * * * *